US009957947B2

(12) United States Patent
Gallatz et al.

(10) Patent No.: US 9,957,947 B2
(45) Date of Patent: May 1, 2018

(54) METHOD FOR INTRODUCING MICROWAVE ENERGY INTO A COMBUSTION CHAMBER OF A COMBUSTION ENGINE AND COMBUSTION ENGINE

(71) Applicant: MWI Micro Wave Ignition AG, Emphingen (DE)

(72) Inventors: Armin Gallatz, Empfingen (DE); Volker Gallatz, Sulz-Bergfelden (DE)

(73) Assignee: MWI Micro Wave Ignition AG, Empfingen (DE)

( * ) Notice: Subject to any disclaimer, the term of this patent is extended or adjusted under 35 U.S.C. 154(b) by 161 days.

(21) Appl. No.: 15/040,612

(22) Filed: Feb. 10, 2016

(65) Prior Publication Data

US 2016/0265503 A1 Sep. 15, 2016

(30) Foreign Application Priority Data

Mar. 3, 2015 (EP) ..... 15157324

(51) Int. Cl.
*F02P 23/00* (2006.01)
*F02P 23/04* (2006.01)
(Continued)

(52) U.S. Cl.
CPC ..... *F02P 23/045* (2013.01); *F02F 1/24* (2013.01); *H05H 2001/463* (2013.01)

(58) Field of Classification Search
CPC ..... F02F 1/24; F02P 23/045; H05H 2001/463
USPC ..... 123/279, 664, 665, 620, 633, 617, 123/536–539; 313/153, 155; 315/149, 315/153, 338, 343
See application file for complete search history.

(56) References Cited

U.S. PATENT DOCUMENTS 3,230,939 A * 1/1966 Goossak ..... F02B 19/1004 123/258
4,434,753 A * 3/1984 Mukainakano ..... F02B 45/08 123/143 B (Continued)

FOREIGN PATENT DOCUMENTS

DE 10356916 A1 6/2005
DE 10201116340 5/2013

(Continued)

*Primary Examiner* — Marguerite McMahon
*Assistant Examiner* — Tea Holbrook
(74) *Attorney, Agent, or Firm* — Von Rohrscheidt Patents

(57) ABSTRACT

A method for introducing microwave energy into a combustion chamber of a reciprocating internal combustion engine with at least one cylinder with a cylinder head in which the microwaves reach the combustion chamber through a microwave window, wherein the microwaves are run about a circumference of the combustion chamber and radially injected into the combustion chamber through at least a portion of a combustion chamber wall functioning as a microwave window. The method and the internal combustion engine facilitate a precise control of a beginning of a space ignition of a fuel air mix in the combustion chamber so that an optimum low emission combustion of a fuel is achieved with an efficiency that is higher compared to conventional reciprocating piston combustion engines. In general the invention provides safe ignition of lean fuel air mixtures.

9 Claims, 4 Drawing Sheets

(51) Int. Cl.
*F02F 1/24* (2006.01)
*H05H 1/46* (2006.01)

(56) References Cited

U.S. PATENT DOCUMENTS 4,561,406 A * 12/1985 Ward ..... F02B 23/08 123/143 B
4,726,336 A * 2/1988 Hoppie ..... F02M 27/06 123/143 B
4,987,284 A * 1/1991 Fujimura ..... H01J 37/32357 156/345.41
6,053,140 A * 4/2000 Feichtinger ..... F02P 23/045 123/143 B
7,770,551 B2 * 8/2010 Gallatz ..... F02P 23/045 123/143 B
9,022,006 B2 * 5/2015 Segawa ..... F02M 29/00 123/299
9,273,599 B2 * 3/2016 Ikeda ..... F02P 9/007
2007/0209634 A1 * 9/2007 Minami ..... F02P 5/00 123/310
2007/0240660 A1 * 10/2007 Gallatz ..... F02P 23/045 123/143 B
2010/0236511 A1 * 9/2010 Elkanick ..... F02B 5/00 123/1 A
2011/0023458 A1 * 2/2011 Ikeda ..... F01N 3/0892 60/275
2011/0030660 A1 * 2/2011 Ikeda ..... F02B 1/02 123/536
2013/0160752 A1 * 6/2013 Kim ..... F02P 13/00 123/636
2014/0014053 A1 * 1/2014 Kaneko ..... F02P 9/007 123/143 B
2014/0312767 A1 * 10/2014 Tian ..... H01J 37/32238 315/39

FOREIGN PATENT DOCUMENTS

EP 2065592 A1 6/2009
WO WO 2009113691 A1 * 9/2009 ..... F01N 3/0892

* cited by examiner

METHOD FOR INTRODUCING MICROWAVE ENERGY INTO A COMBUSTION CHAMBER OF A COMBUSTION ENGINE AND COMBUSTION ENGINE

RELATED APPLICATIONS

This application claims priority from and incorporates by reference European Patent Application 15 157 324.3 filed on Mar. 3, 2015.

FIELD OF THE INVENTION

The invention relates to a method for introducing microwave energy into a combustion chamber of a reciprocating piston internal combustion engine including at least one cylinder with a cylinder head in which the microwaves are introduced into the combustion chamber. The invention also relates to an internal combustion engine.

BACKGROUND OF THE INVENTION

DE 103 56 916 A1 discloses to generate a space ignition in a combustion chamber in an internal combustion engine in order to better ignite and combust a fuel air mixture of an introduced fuel.

In conventional engines an ignitable mixture is compressed in a cone shaped cylinder head and caused by a spark plug to react to and oxidize. Thus, a chemical oxidation spreads cone shaped from an ignition location as a pressure and reaction front (laminar combustion gas phase). The pressure front moves faster than the reaction front and therefore reaches a cylinder edge first. The pressure front is reflected at the cylinder edge and runs towards the reaction front. When both fronts meet the reaction can die down which degrades efficiency and causes pollutants.

Replacing the local ignition by a space ignition through microwaves mitigates this effect. Before ignition the mixture shall be excited over the entire volume as homogeneously as possible which requires absorption that is distributed over the combustion chamber. Thus, an absorption capability for microwaves described by a material parameter tan δ (t) and an associated penetration depth are important.

During compression a pressure and temperature dependent ionization of the mixture to be ignited is already performed. Due to this ionization of particular fuel molecules absorption rates of the microwaves by the ignitable mixture in the combustion chamber have to be expected which vary time based over the compression process.

Since the described homogeneity can never be achieved entirely in practical applications the reaction front shall run from an outside in inward direction. Therefore a microwave feed has to be found which generates a field distribution in the circular cylindrical combustion chamber wherein the field distribution increases homogeneously along the entire circumference and increases as homogeneously as possible along a radius or advantageously monotonously increases for larger radii. The homogeneity of the field distribution shall be rendered as independent as possible from absorption properties of the mixture.

BRIEF SUMMARY OF THE INVENTION

Thus, it is an object of the invention to achieve an ignition distribution in the entire combustion cavity that is a homogeneous as possible, or to generate local ignition cores at least in an edge portion of the combustion chamber.

The object is achieved according to the invention through a method for injecting microwave energy into a combustion chamber of a reciprocating internal combustion engine with at least one cylinder with a cylinder head, comprising the steps running microwaves about a circumference of a combustion chamber; and radially injecting the microwaves into the combustion chamber through at least a portion of a combustion chamber wall functioning as a microwave window.

The object is also achieved by an internal combustion engine including at least one cylinder with a cylinder head and a piston in which microwaves are injected through a microwave window into a combustion chamber, wherein the combustion chamber includes a combustion chamber wall which functions as a microwave window at least in portions, and wherein the combustion chamber wall is enveloped by at least one circumferential annular hollow conductor cavity with at least one feed for the microwave and at least one outlet opening for the microwave which outlet opening is oriented towards the combustion chamber wall. Additional advantageous embodiments can be derived from the respective dependent claims.

According to the method according to the invention microwaves are run around a circumference of the combustion chamber and radially injected into the combustion chamber through at least one portion of a combustion chamber wall acting as a microwave window. Thus, at least a portion of the combustion chamber wall, for example of a cylinder of an internal combustion engine, is made from a suitable material which performs the function of the microwave window for injecting the microwaves, but which is simultaneously suitable for the combustion chamber due to its strength and temperature stability. This can be for example a ceramic material advantageously with a purity >99% or another solid material that is permeable for microwaves. Thus, the microwaves can be run only in one plane or also in different planes in opposite directions or in identical directions about the combustion chamber and they can be injected into the combustion chamber through the combustion chamber wall. The conduction about the combustion chamber can then be performed about a combustion chamber wall that is configured solid and acts as a microwave window or the conduction of the microwaves can also be provided in the combustion chamber wall itself for example in a ceramic material with a coated surface with openings on the combustion chamber side, so that the openings are used as outlet openings for the microwaves. Subsequently the combustion chamber wall of the method relates to both variants.

Advantageously the microwaves are injected into the combustion chamber through at least one annular hollow conductor cavity arranged at the circumference of the combustion cavity wherein the hollow conductor cavity includes at least one outlet opening oriented towards the combustion chamber. Thus, the microwaves are introduced into an annular hollow conductor cavity providing optimum wave conduction while avoiding mode leaps and reflections wherein a cross section of the all annular hollow conductor cavity can be rectangular, especially square, circular or oval. The cross section is advantageously square in order to prevent flash ovens in the annular hollow conductor cavity. The annular hollow conductor cavity can either be arranged directly adjacent to the combustion cavity wall or as recited supra in the combustion cavity wall so that the microwaves which radially exit through at least one outlet opening in the annular hollow conductor cavity in a direction towards the combustion chamber are directly injected through the microwave window into the combustion cavity. The at least one outlet opening can thus extend over an entire circumference of the combustion cavity or also only over only portions thereof.

Advantageously the microwaves are conducted at an end of the annular hollow conductor cavity into the combustion chamber at an angle in order to prevent reflections of the microwaves that have already run around the combustion chamber at an end of the annular conductor cavity back to a microwave source or in order to at least substantially mitigate those reflections.

Advantageously the microwaves are introduced from the annular hollow conductor cavity through a circumferential gap between the annular hollow conductor cavity and the combustion chamber wall which gap increases with a length of a path of the microwave in the hollow conductor cavity or through a plurality of gaps advantageously increasing with the length of the path of the microwave in the annular hollow conductor cavity wherein the gaps are arranged perpendicular to a propagation direction of the microwave between the annular hollow conductor cavity and the combustion chamber wall or a combination thereof. These measures are used to concentrate microwave energy in sufficient quantity at a maximum number of locations in the combustion chamber in order to generate a space ignition in the combustion chamber through a plurality of ignition cores.

Advantageously the microwaves are introduced with a frequency of 25 GHz to 90 GHz, advantageously 36 GHz since it has become apparent that these frequencies generate the desired space ignition in the combustion cavity.

It is furthermore advantageous when the microwaves are introduced in impulse packets wherein the impulse packets are advantageously also maintained after an ignition of a fuel air mixture that has already been performed. Thus, the ignition of the fuel air mixture is optimized and the combustion of the fuel air mixture is further excited even after the ignition has already been performed and the combustion chamber may already be expanding.

It is a particular advantage of the method that the microwaves are introduced as function of crank shaft angle degrees so that a precise control of the ignition can be performed.

In the internal combustion engine according to the invention with at least one cylinder with a cylinder head in which the microwaves are introduced through a microwave window into the combustion chamber the combustion chamber includes at least one combustion chamber wall which functions in portions as a microwave window wherein the combustion chamber wall is enveloped by at least one circumferential annular hollow conductor cavity with at least one feed for the microwave and at least one outlet opening for the microwave oriented towards the combustion chamber wall. The combustion chamber wall can thus be made from a ceramic material or another suitable material and can be introduced into the cylinder as an insert.

Advantageously in order to avoid reflections at an end of the annular conductor cavity a wall is arranged at this location that is disposed at an angle to the annular hollow conductor cavity and an outlet opening in a direction towards the combustion chamber wall.

The internal combustion engine advantageously includes a circumferential gap between the annular hollow conductor cavity and the combustion chamber wall, wherein the gap increases with the length of the path of the microwave in the annular hollow conductor cavity or the internal combustion engine includes a plurality of gaps that advantageously increase with the length of the path of the microwave in the annular hollow conductor cavity and that are arranged perpendicular to the propagation direction of the microwave between the annular hollow conductor cavity and the combustion chamber wall or a combination thereof.

Advantageously also an additional, advantageously identical hollow conductor cavity can be provided adjoining the first annular hollow conductor cavity wherein the additional annular hollow conductor cavity is for example arranged with outlet openings that are offset relative to the outlet openings of the first annular hollow conductor cavity and which includes a feed that is arranged opposite to a feed of the first annular hollow conductor cavity. Additionally points for local field augmentation and generation of ignition cores can be provided in the combustion cavity, in particular in the cylinder head. If necessary at least one additional microwave spark plug according to the co-owned application EP 15 15 72 98.2 can be arranged in the cylinder head.

The mathematical description of the injection is based on a cylinder coordinate system r, φ, z. In a circular cylindrical space that is defined with electrically conductive borders a distribution of the electromagnetic waves along the circumference is defined by sine- or cosine functions and defined by cylinder functions also designated Bessel functions along the radius. Depending on an orientation of the field lines the associated Eigen modes are designated T $E_{mn}$, T or $M_{mn}$ modes. Thus, the first index m corresponds to the number of azimuthal maxima, the second index n corresponds to the number of radial maxima. Modes with high azimuthal index and low radial index are designated as Whispering Gallery Modes WGM. Their power oscillates substantially at an edge of the hollow cylinder. With increasing radial index the oscillating power moves into the interior of the combustion chamber.

A superposition of two modes that are offset by π/(2m) azimuthally and time based but which are identical otherwise lead to a rotating mode. These are quite well known in literature. Mathematically an azimuthally standing mode is expressed by two counter rotating modes using the following equation.

$$2\cos m\varphi e^{-i\omega t}=(e^{im\varphi}+e^{-im\varphi})e^{-i\omega t}$$

In case m=0 there is an azimuthally constant distribution.

A similar equation applies in radial direction. The Bessel function describing radially standing waves can be broken down into inward and outward propagating Hankel functions:

$$2J_m(k_r r)=H_{m2}(k_r r)+H_{m1}(k_r r)$$

wherein kr is the radial wave number. A field distribution proportional to $$e^{im\varphi}*H_{m2}(k_r r)$$

describes a mode whose power propagates inward in a spiral shape. The associated face fronts become steeper and steeper with decreasing radius. According to the invention an ignition with maximum homogeneity along the circumference is optionally achieved in an outer portion of the cylinder or in the entire volume in that either a rotating Whispering Gallery Mode or a volume mode is excited in the combustion cavity in a controlled manner. Thus, a feed wave conductor, advantageously a rectangular wave conductor in the form of the annular hollow conductor cavity is wound about the combustion chamber. From theory it is known that the hollow conductor wave length of its modes can be changed by the transversal geometric dimensions. The feed wave conductor and the cylindrical combustion cavity are therefore connected with each other in one embodiment by periodic openings through the combustion cavity wall acting as microwave window which injects power from the wave conductor into the combustion cavity. Now the period p of the openings is selected so that $$p = \frac{2*\pi}{k_l}$$

wherein $k_l$ is the axial wave number of the mode in the wound wave conductor which excites a T $E_{0n}$ mode in the combustion chamber in a controlled manner. This mode in an ideal case would have circular inward running face fronts with constant amplitude. The fed in power reaches the opposite wall directly and can already be injected back into the wound feed wave conductor at this location. The covered path length in the combustion cavity thus corresponds to a diameter of the combustion cavity. In case of bad absorption of the mix to be ignited a considerable portion of the power is injected back into the feed wave conductor and reflected to the microwave source.

Therefore a slightly different period of the openings is selected as an alternative according to the invention. Thus, the face fronts are inclined. The power propagates in a spiral shape into the combustion cavity which facilitates a high path length and thus an absorption of the microwave power that is largely independent from tan δ. The width of the openings is varied so that the power injected into the combustion chamber is constant along the circumference As described supra the surfaces with constant phase are inclined the more relative to the radius, the smaller the radius becomes. There is a radius at which the power only propagates in the azimuthal direction. This leads to a portion without field in an interior of the combustion chamber. This is advantageous when a fuel concentration is low in a center of the combustion chamber. The excited modes correspond to the already recited Whispering Gallery Modes. This coupling is reached in a particularly efficient manner when the wave length in the wound wave conductor is shortened relative to the clear space wave length. Thus, the wave conductor is filled with a non absorbing dielectric material.

Strong field augmentations can be obtained at an edge with simultaneously comparatively weaker excitation of the field in a center in that the injecting period is selected so that injecting is performed into a volume mode as well as into a WGM. This yields a field augmentation in edge portions.

The excitation of the fields at an edge of the combustion cavity can also be controlled time based. Initially a frequency is selected at which an injection is performed by the feed wave conductor into the volume mode exciting the entire combustion chamber. The frequency can be changed subsequently so that an injection is performed into an igniting WGM.

At an end of the wound wave conductor a plate can be arranged that is inclined by an angle of 45° and that rotates the polarization. The microwave power reaching the end of the wound conductor is then reflected in a rotated polarization. The power injected into the combustion cavity in the 90° rotated polarization does not interfere with the power injected in forward direction then.

In some applications it can be required to augment the ignition locally at a slant of the cylinder head. From electromagnetic wave theory it is well known that local field augmentation advantageously occurs at conductive points. When these conductive points are arranged at different locations in the engine (cylinder head) local field augmentations and thus local ignitions are obtained.

The method and the combustion engine thus facilitate precise control of a beginning of a space ignition of a fuel air mixture in a combustion chamber so that an optimum low emission combustion of the fuel is achieved with increased efficiency compared to conventional reciprocating piston internal combustion engines. Typically the invention facilitates safe ignition of lean fuel air mixtures which does not require additional enrichment for achieving ignition and which leads to a lower fuel consumption. Emissions and their generation can be controlled by the combustion temperature and the mix ratio of air and fuel. Combustion according to the invention occurs faster than for conventional ignitions. This causes "colder" combustion so that the efficiency increases. Furthermore lower pollutant emissions are achievable through colder combustion processes as a matter of principle. The colder combustion reduces the concentration of NO in the exhaust gases. Through space ignition the combustion process, differently from conventional combustion, is much less dependent on combustion progress in the form of diffusion flames. This helps to avoid additional heat losses and achieves an efficiency increase. A heat up phase of the combustion chamber and of the air in the oxidation portion is not provided for this type of combustion.

BRIEF DESCRIPTION OF THE DRAWINGS

The invention is subsequently can be described in more detail with reference to schematic drawing figures. Additional features of the invention can be derived from the subsequent description in combination with the patent claims and the appended drawing figures, wherein.

DETAILED DESCRIPTION OF THE INVENTION

Figure 1A:
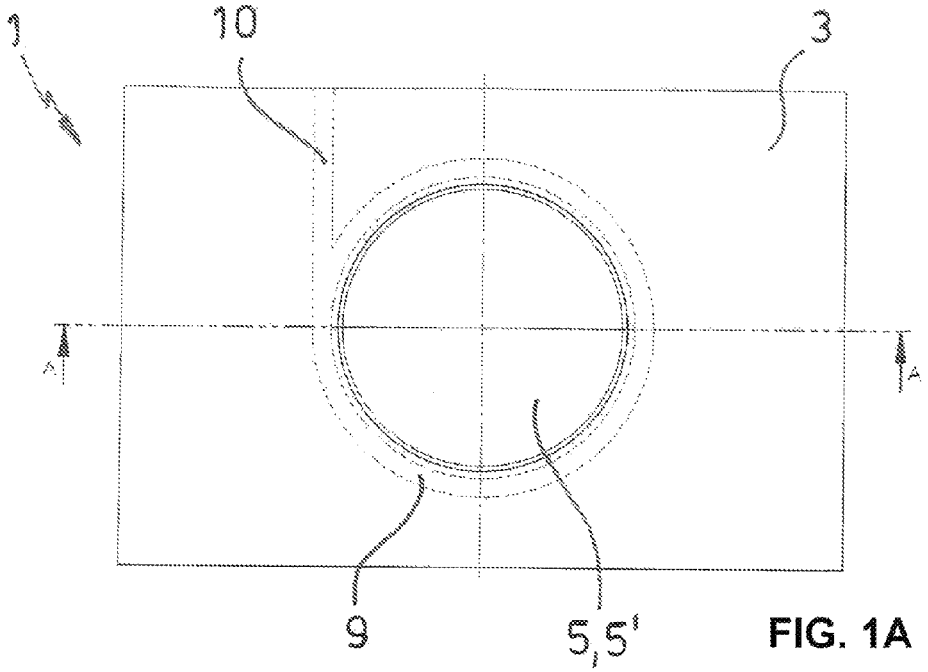
FIG. 1A illustrates an embodiment with annular injection wherein a gap towards the combustion chamber has constant width over a circumference in a schematic top view of a detail of a reciprocating piston internal combustion engine without cylinder head.

In the subsequently described figures the invention is illustrated in an exemplary manner based on various embodiments. Identical or like elements in the individual figures are provided with identical reference numerals.

The figures illustrate a schematic detail of an internal combustion engine 1 with a cylinder head 2 and an engine block 3. The engine block 3 includes a cylinder 4 with a piston 5 that is moveable therein and a combustion chamber 6 partially arranged in the cylinder head 2 above the cylinder 4. A schematically indicated inlet 7 for the fuel air mix leads into the combustion chamber 6. Outlets for the exhaust gas are not illustrated since the outlets can be configured in ways that are well known to a person skilled in the art. The schematically indicated cylinder head 2 with a central inlet 7 for the fuel air mixture can certainly also have additional spark plugs or outlets for the exhaust gases. The spark plugs can be particularly configured microwave spark plugs that are described in the co-owned application EP 15 157 298.9. An additional inner wall 8 is provided in the cylinder 4. The additional wall is made from a material that is suitable for a function of a microwave window. This can be for example a ceramic material, advantageously with a high level of purity, sapphire glass or another suitable material.

Figure 1B:
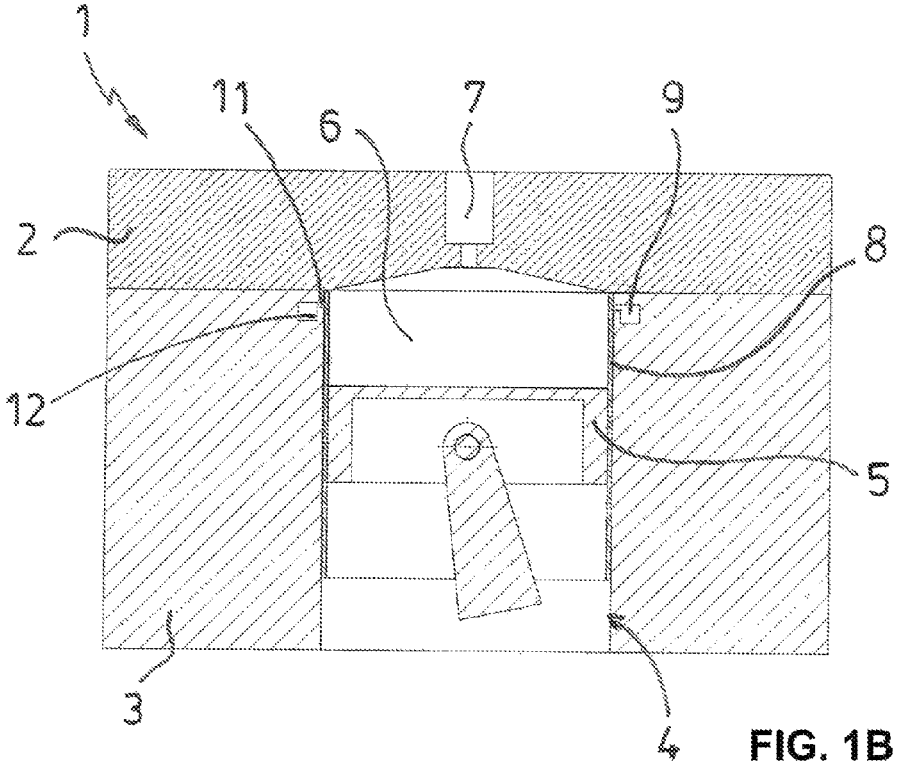
FIG. 1B illustrates a sectional view along the line A-A of FIG. 1*a* with cylinder head.

In FIG. 1A an annular hollow conductor cavity 9 extends in the engine block 3 about the inner wall 8 wherein the annular hollow conductor cavity includes a annular cavity wall 12 with equal height over the entire circumference towards the inner wall 8, so that a gap 11 is formed through which the microwave supplied through the microwave feed 10 reaches the combustion chamber 6 through the inner wall 8 that is being used as microwave window. As described supra injecting the microwaves into the combustion chamber 6 generates ignition cores for a space ignition of the fuel air mix introduced through the inlet into the combustion chamber 6. FIGS. 1A and 1B illustrate the arrangement of the individual components. In the embodiment according to FIG. 1A the microwave feed 10 is illustrated as a tangential feed wherein this feed can also be provided radially or at an intermediary angle.

Figure 2A:
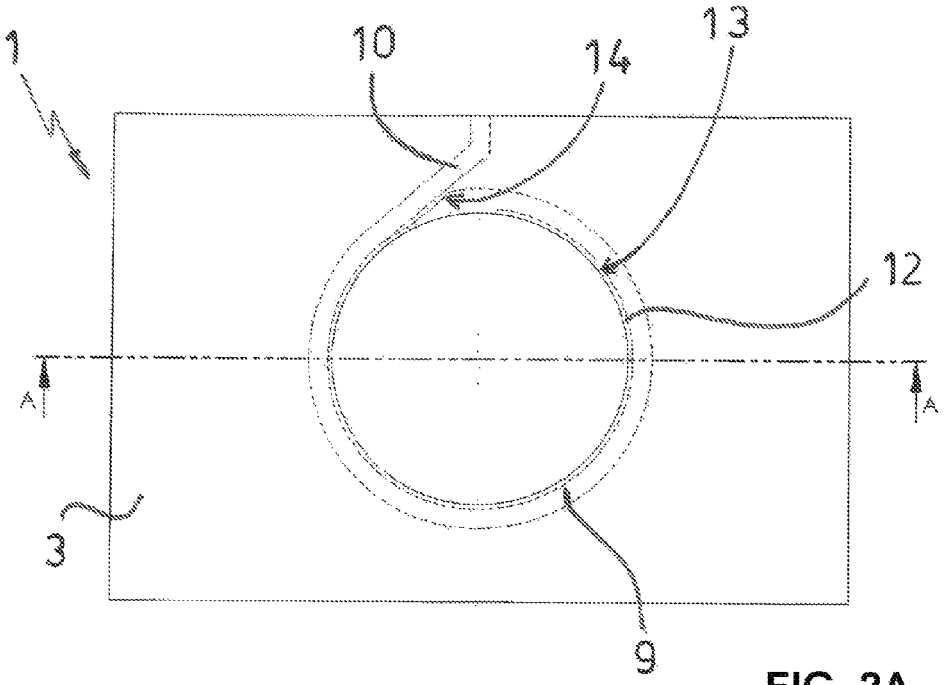
FIG. 2A illustrates a representation similar to FIG. 1 for a ring injection with a gap increasing over a length of the annular path in a schematic top view without cylinder head.
Figure 2B:
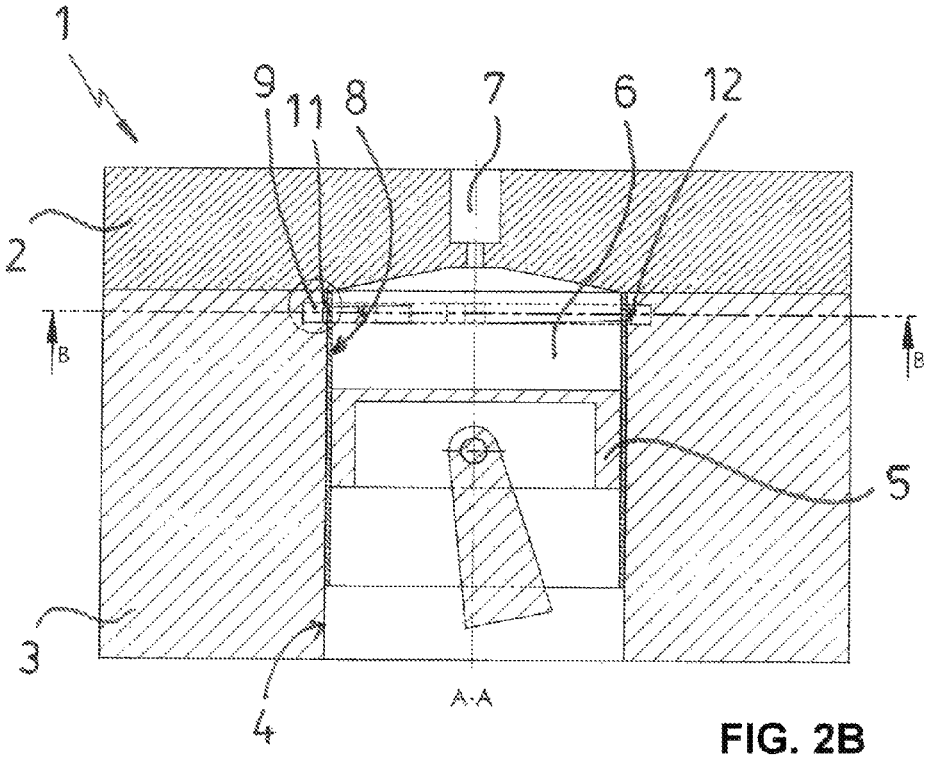
FIG. 2B illustrates a sectional view along the line A-A of FIG. 2A with a cylinder head
Figure 2C:
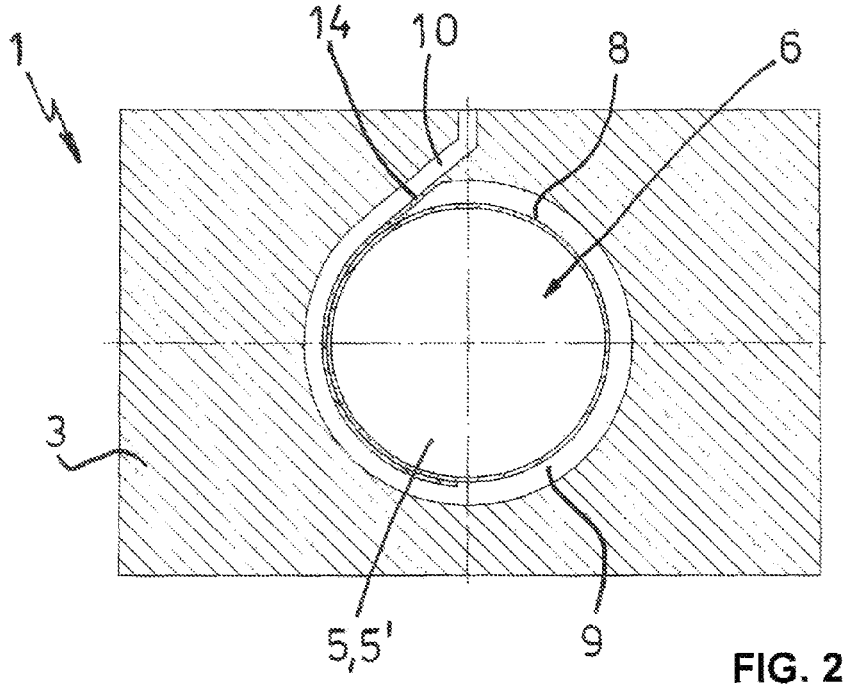
FIG. 2C illustrates a sectional view along the line B-B in FIG. 2B.

FIG. 2 illustrates a similar embodiment wherein the annular cavity wall 12 decreases in height over the length of the path along the inner wall 8 and thus forms a gap 11 that becomes larger and larger in size. As evident from FIG. 2A the annular cavity wall 12 terminates before reaching the face wall 14 so that an opening 13 over an entire height of the annular hollow conductor cavity 9 is obtained. The microwave feed 10 in this embodiment is selected so that the face wall 14 is formed which has the consequence that the microwaves are reflected back by the annular hollow conductor cavity 9 as little as possible but so that they are introduced into the combustion chamber 6 at an angle instead. FIG. 2C illustrates the facts described supra in a different view.

Figure 3A:
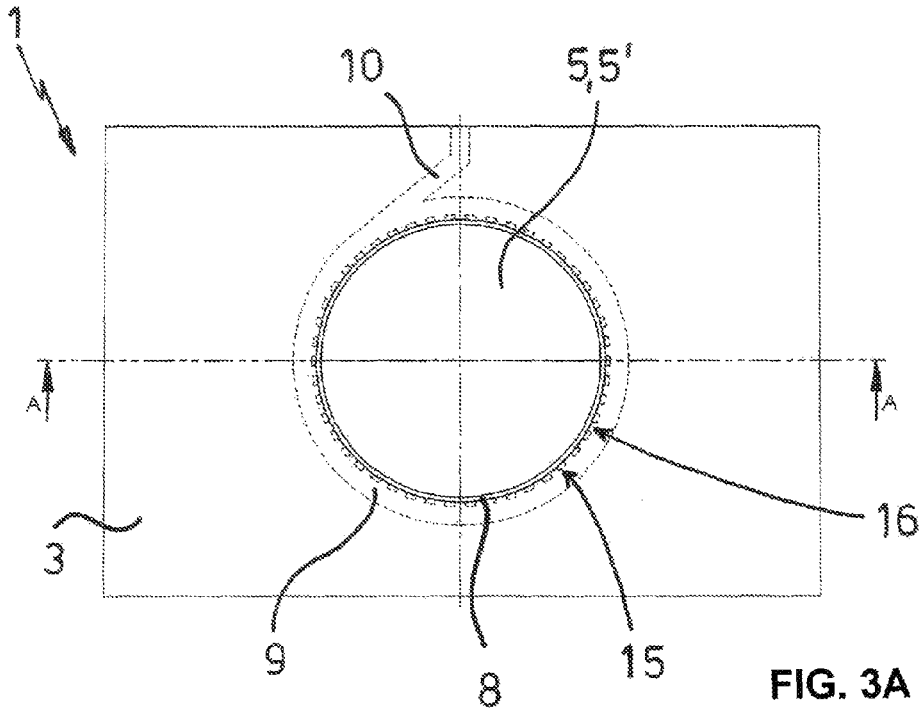
FIG. 3A illustrates a representation according to FIG. 2 with ring injection with individual bars offset from one another in a schematic top view without cylinder head (FIG. 3A)
Figure 3B:
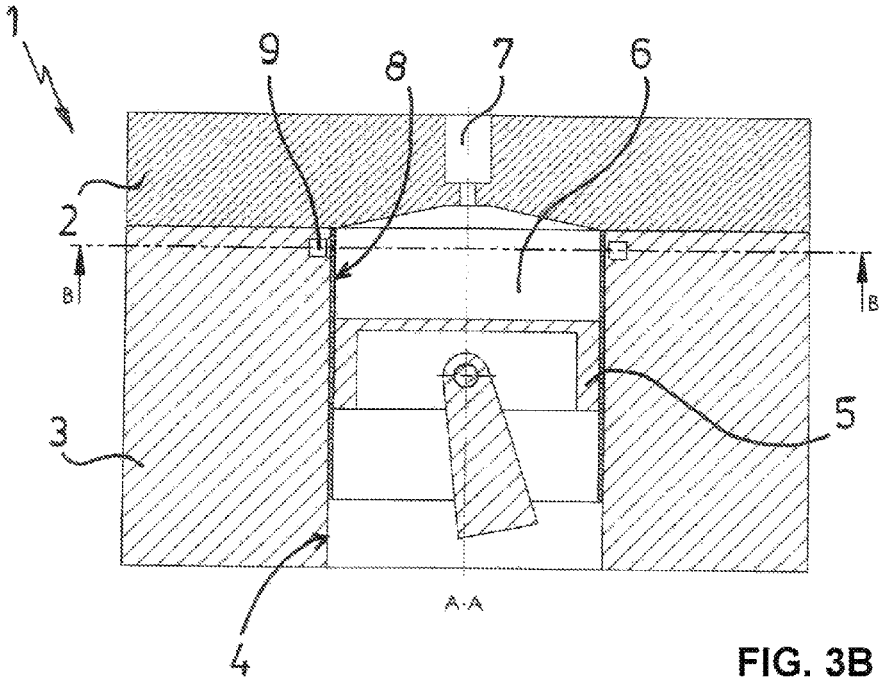
FIG. 3B illustrates a sectional view along the line A-A of FIG. 3A with a cylinder head.
Figure 3C:
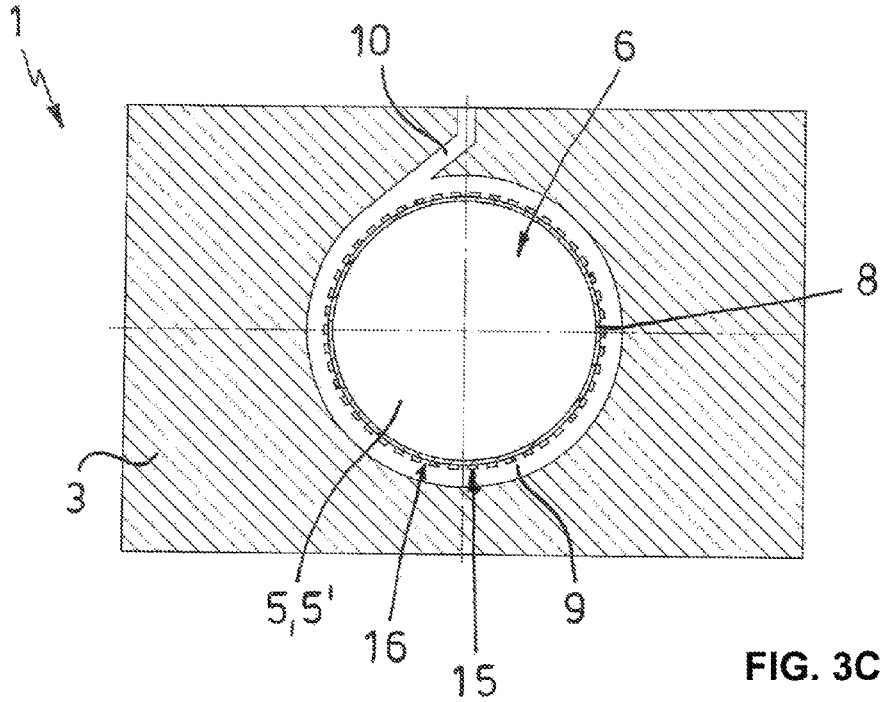
FIG. 3C illustrates a sectional view along the line B-B of FIG. 3B.

FIG. 3 illustrates an embodiment in which the microwave feed is configured tangential in turn and the annular hollow conductor cavity 9 is continuous like in the embodiment of FIG. 1 and not interrupted like in the embodiment according to FIG. 2. The annular cavity wall 12 in this embodiment is made from individually offset bars 15 so that the microwave introduced through the microwaves feed 10 can reach the combustion chamber 6 through the intermediary spaces 16 between the bars 15 through the inner wall 8 acting as a microwave window In the embodiment the bars 15 have the same width and height and the intermediary space 16 between the individual bars is equal in size. The height as well as the width of the bars 15 as well as the width of the intermediary space 16 can be varied according to the application.

In the illustrated embodiments the annular hollow conductor cavity 9 is arranged in the engine block 3 about the cylinder 4. It is also possible to configure the annular hollow conductor cavity 9 in a cylinder head 2 that is increased in height.

The engine blocks are made from a typical material, typically metal, wherein the material can be selected according to the application. The boundary for the microwaves in the illustrated hollow conductor cavities is certainly made from metal, wherein additional measures can be taken in order to optimize conductivity, for example by surface coating with a highly electrically conductive material.

What is claimed is:

1. A method for injecting microwave energy into a combustion chamber of a reciprocating internal combustion engine with at least one cylinder with a cylinder head, comprising the steps:

running microwaves though at least one annular hollow conductor cavity arranged at a circumference of a combustion chamber; and radially injecting the microwaves into the combustion chamber through at least a portion of a combustion chamber wall functioning as a microwave window, wherein the combustion chamber wall separates the combustion chamber from the at least on annular hollow conductor cavity and is made from a solid temperature stable material which is permeable for the microwaves, wherein the at least one annular hollow conductor cavity includes at least one opening oriented towards the combustion chamber, and wherein the at least one annular hollow conductor cavity is integrated into an engine block of the reciprocating internal combustion engine.

2. The method according to claim 1, wherein the microwaves are injected into the combustion chamber at an angle of 45° at an end of the at least one annular hollow conductor cavity so that the microwaves that are injected into the combustion chamber an angle of 45° at an end of the at least one annular hollow conductor cavity do not interfere with microwave energy injected in a forward direction.

3. The method according to claim 1, wherein the microwaves are injected from the annular hollow conductor cavity through a circumferential gap extending between the annular hollow conductor cavity and the combustion chamber wall, or through a circumferential gap extending between the annular hollow conductor cavity and the combustion chamber wall which circumferential gap increases in size with a length of a path of the microwave in the annular hollow conductor cavity, or through a plurality of intermediary spaces which increase in size with the length of the path of the microwave in the annular hollow conductor cavity and which are arranged perpendicular to a propagation direction of the microwaves between the annular hollow conductor cavity and the combustion chamber wall, or through a combination thereof.

4. The method according to claim 1, wherein the microwaves are injected with a frequency of 25 GHz to 90 GHz.

5. The method according to claim 1, wherein the microwaves are introduced in impulse packets, and wherein the impulse packets are maintained after an ignition of a fuel air mix has already been performed.

6. The method according to claim 1, wherein the microwaves are injected as a function of an angular position of a crank shaft.

7. An internal combustion engine, comprising:

at least one cylinder with a cylinder head and a piston in which microwaves are injected through a microwave window into a combustion chamber, wherein the combustion chamber includes a combustion chamber wall which functions as a microwave window at least in portions, and wherein the combustion chamber wall is enveloped by at least one circumferential annular hollow conductor cavity with at least one feed for the microwave and at least one outlet opening for the microwave which outlet opening is oriented towards the combustion chamber wall, wherein the combustion chamber wall separates the combustion chamber from the at least on annular hollow conductor cavity and is made from a solid temperature stable material which is permeable for the microwaves, and wherein the at least one annular hollow conductor cavity is integrated into an engine block of the reciprocating internal combustion engine.

8. The internal combustion engine according to claim 7, wherein a face wall that is oriented at an angle of 45° relative to the at least one annular hollow conductor cavity and an outlet opening in a direction towards the combustion chamber wall are arranged at an end of the at least one annular hollow conductor cavity.

9. The internal combustion engine according to claim 7, wherein a circumferential gap extending between the at least one annular hollow conductor cavity and the combustion chamber wall, a circumferential gap extending between the at least one annular hollow conductor cavity and the combustion chamber wall which circumferential gap increases in size with a length of a path of the microwave in the at least one annular hollow conductor cavity, or a plurality of intermediary spaces which advantageously increase in size with the length of the path of the microwave in the at least one annular hollow conductor cavity and which are arranged perpendicular to a propagation direction of the microwave between the at least one annular hollow conductor cavity and the combustion chamber wall, or a combination thereof is provided.

* * * * *